US011450975B2

(12) United States Patent
Wang

(10) Patent No.: US 11,450,975 B2
(45) Date of Patent: Sep. 20, 2022

(54) COPPER-ALUMINIUM CONNECTOR

(71) Applicant: JILIN ZHONG YING HIGH TECHNOLOGY CO., LTD., Jilin (CN)

(72) Inventor: Chao Wang, Jilin (CN)

(73) Assignee: JILIN ZHONG YING HIGH TECHNOLOGY CO., LTD., Jilin (CN)

( * ) Notice: Subject to any disclaimer, the term of this patent is extended or adjusted under 35 U.S.C. 154(b) by 110 days.

(21) Appl. No.: 16/619,466

(22) PCT Filed: May 31, 2018

(86) PCT No.: PCT/CN2018/089208
§ 371 (c)(1),
(2) Date: Dec. 5, 2019

(87) PCT Pub. No.: WO2018/223886
PCT Pub. Date: Dec. 13, 2018

(65) Prior Publication Data

US 2021/0226353 A1 Jul. 22, 2021

(30) Foreign Application Priority Data

Jun. 5, 2017 (CN) ..... 201720642529.2

(51) Int. Cl.
*H01R 11/12* (2006.01)
*H01R 4/18* (2006.01)
*H01R 4/62* (2006.01)

(52) U.S. Cl.
CPC ..... *H01R 4/625* (2013.01); *H01R 4/183* (2013.01); *H01R 11/12* (2013.01)

(58) Field of Classification Search
CPC ..... H01R 4/183; H01R 4/62; H01R 4/625; H01R 4/18; H01R 4/029; H01R 11/12; H01R 43/16; H01R 2201/26
(Continued)

(56) References Cited

U.S. PATENT DOCUMENTS 2,806,215 A * 9/1957 Redslob ..... H01R 11/12 439/868
3,239,646 A * 3/1966 Goode ..... B23K 9/22 219/95

(Continued)

FOREIGN PATENT DOCUMENTS

CN 201629412 U 11/2010
CN 202294624 U 7/2012

(Continued)

OTHER PUBLICATIONS

Search Report dated Feb. 10, 2021 for European patent application No. 18814380.4.

(Continued)

*Primary Examiner* — Timothy J Thompson
*Assistant Examiner* — Guillermo J Egoavil
(74) *Attorney, Agent, or Firm* — Yue (Robert) Xu; Apex Attorneys at Law, LLP

(57) ABSTRACT

A copper-aluminum connector includes at least one copper terminal for connection to a power consumption device, and at least one aluminum wire for connection to an electrical circuit, wherein, the copper-aluminum connector further includes a connecting part, and the connecting part includes at least one first connecting end for connection to an end portion of the copper terminal and at least one second connecting end for connection to the aluminum wire.

16 Claims, 1 Drawing Sheet

(58) Field of Classification Search
USPC ..... 174/94 R; 439/624, 874, 730
See application file for complete search history.

(56) References Cited

U.S. PATENT DOCUMENTS

| | | | | |
|---|---|---|---|---|
| 3,656,092 | A * | 4/1972 | Swengel, Sr. ..... | H01R 4/723<br>439/730 |
| 3,876,280 | A * | 4/1975 | Jones ..... | H01R 43/16<br>439/879 |
| 8,840,437 | B2 | 9/2014 | Hentschel et al. | |
| 2013/0059473 | A1* | 3/2013 | Hentschel ..... | H01R 4/029<br>439/624 |
| 2015/0155673 | A1* | 6/2015 | Kawamura ..... | H01R 43/05<br>29/860 |
| 2017/0162953 | A1* | 6/2017 | Kojima ..... | H01R 4/625 |
| 2018/0062298 | A1* | 3/2018 | Mogi ..... | H01R 27/02 |
| 2019/0260145 | A1 | 8/2019 | Chao | |

FOREIGN PATENT DOCUMENTS

| | | | | |
|---|---|---|---|---|
| CN | 106450868 | A | 2/2017 | |
| CN | 206195014 | U | 5/2017 | |
| CN | 206893815 | U | 1/2018 | |
| EP | 2579390 | A1 | 4/2013 | |
| JP | 2016105363 | A * | 6/2016 ..... | H01R 4/18 |

OTHER PUBLICATIONS

International Search Report for PCT/CN2018/089208 dated Sep. 10, 2018, ISA/CN.

* cited by examiner

COPPER-ALUMINIUM CONNECTOR

CROSS-REFERENCE TO RELATED APPLICATIONS

The present application is the national phase of International Application No. PCT/CN2018/089208, titled "COPPER-ALUMINIUM CONNECTOR", filed on May 31, 2018, which claims the priority of the Chinese Patent Application No. 201720642529.2, the entire disclosures of which are incorporated herein by reference.

FIELD

The present application relates to a copper-aluminum connector for mounting on a power consumption device.

BACKGROUND

Terminals of power consumption devices, especially such as cars, trains, ships, aircrafts, mechanical equipment, power grids, are usually made of copper, and aluminum has become the most commonly used cable material due to its advantages of easy availability and light weight. However, when an aluminum wire is directly connected to a copper terminal, it is apt to produce a galvanic reaction due to a great electrode potential difference between copper and aluminum, which may make the aluminum wire prone to electrochemical corrosion, thus when the power consumption device is operated for a long time, overloaded or short-circuited, it is extremely easy to cause a safety accident. Therefore, a treated copper-aluminum connector or a copper-aluminum transition plate is often used to connect the copper terminal and the aluminum wire.

For example, a Chinese utility model patent CN 201320368882.8 discloses a copper-aluminum joint, which includes an aluminum wire, an aluminum tube, a copper terminal and a welding layer, the aluminum wire includes a wire harness and an insulating layer wrapping the outside of the wire harness; the aluminum tube is sleeved on the aluminum wire, one end of the aluminum tube is located on the wire harness at the end of the aluminum wire that the insulating layer is removed, and another end of the aluminum tube is located on the adjacent insulating layer; the inside of the aluminum tube is stepped, an inner stepped surface matches with an end surface of the insulating layer; and the welding layer is located between the aluminum wire and the copper terminal, and a truncated end portion of the wire harness in the aluminum tube is welded to the end portion of the copper terminal by friction welding.

However, the aluminum tube and the aluminum wire are prone to deformation or cracking when the copper terminal and the aluminum tube are welded by friction welding due to the disadvantages of aluminum, such as poor mechanical strength and poor creep resistance, which leads to a problem of unstable pull-out force between the copper terminal and the wire harness which are welded together. Moreover, most of the existing copper-aluminum connectors or copper-aluminum terminals can only realize the one-way connection between the copper terminal and the aluminum wire, thus for a power consumption device with a large current demand, multiple copper-aluminum connectors or copper-aluminum terminals are needed at the same time to meet the demand.

SUMMARY

The technical problem to be solved by the present application is to provide a copper-aluminum connector which can not only further increase a pull-out force between a copper terminal and an aluminum wire, but also has high use efficiency.

In order to solve the above problems, the following technical solutions are adopted in the present application.

A copper-aluminum connector includes at least one copper terminal for connection to a power consumption device, and at least one aluminum wire for connection to an electrical circuit, wherein, the copper-aluminum connector further includes a connecting part, and the connecting part comprises at least one first connecting end for connection to an end portion of the copper terminal and at least one second connecting end for connection to the aluminum wire.

Further, the end portion of the copper terminal is connected to the first connecting end by crimping.

Preferably, the end portion of the copper terminal is connected to the first connecting end by welding.

More preferably, welding surfaces of the first connecting end and the end portion of the copper terminal are either a plane, a curved surface or a folded surface.

More preferably, a diameter of an end surface of the first connecting end is not less than ⅕ of a diameter of the end portion of the copper terminal, and not greater than 3 times the diameter of the end portion of the copper terminal.

Further, the aluminum wire is connected to the second connecting end by crimping.

Preferably, the aluminum wire is connected to the second connecting end by welding.

More preferably, the copper-aluminum connector further includes at least one crimping terminal for crimping to the aluminum wire, and after being connected by crimping, the crimping terminal and the aluminum wire are connected to the second connecting end by friction welding.

More preferably, a cross section of the second connecting end is circular or polygonal.

Preferably, the connecting part is a solid structure or a hollow structure.

Preferably, the connecting part is made of aluminum, aluminum alloy, copper, copper alloy, zinc, zinc alloy, magnesium, magnesium alloy, nickel, nickel alloy, tin, tin alloy, manganese, manganese alloy, lithium or lithium alloy.

Preferably, the connecting part is made of silver, silver alloy, gold, gold alloy, boron, boron alloy or graphene.

Compared with the conventional technology, the present application has the following beneficial effects.

1. The connecting part includes at least one first connecting end for connection to the copper terminal and at least one second connecting end for connection to the aluminum wire, and in this way, it is convenient for people to determine the numbers of the copper terminal, the aluminum wire, the first connecting end and the second connecting end according to the actual needs, thus the copper-aluminum connector can be directly applied to a power consumption device with a large current demand, which not only saves the use space and cost, but also improves the assembly efficiency, so that the copper-aluminum connector has higher use efficiency.

2. The connecting part can be connected to the copper terminal and the aluminum wire by welding or crimping, so that people can choose a suitable manner to connect the connecting part to the copper terminal and the aluminum wire according to the different production conditions and the product requirements of the copper-aluminum connector, which is more convenient. Moreover, when the connecting part is connected to the end portion of the copper terminal and/or the aluminum wire by welding, the stability after the connecting part is connected with the copper terminal and/or the aluminum wire can be improved. When the connecting part is connected to the copper terminal and/or the aluminum wire by crimping, the connection mode is simple, and the connection between the connecting part and the copper terminal and/or the aluminum wire can be completed in a short time, thus improving the production efficiency.

3. The copper-aluminum connector further includes at least one crimping terminal, and after being crimped onto the aluminum wire, the crimping terminal is welded to the second connecting end, so that a stable and firm connection layer is formed at the second connecting end by the aluminum wire and the connecting part, so that the stability of the pull-out force between the aluminum wire and the connecting part is high on the premise of ensuring the electrical conductivity.

4. The connecting part is a solid structure or a hollow structure. When the connecting part is the solid structure, not only the process of connecting the connecting part to the copper terminal and the aluminum wire can be more stable, but also the mechanical performance of the connecting part after being connected to the copper terminal and the aluminum wire can be guaranteed. When the connecting part is the hollow structure, the production cost of the connecting part can be effectively reduced.

The above description is only a summary of the technical solutions of the present application for better understanding of the technical means of the present application, which can be implemented according to the contents of the specification, and in order to make the above and other objects, features and advantages of the present application more apparent and easy to understand, preferred embodiments will be described in detail with reference to the drawings hereinafter.

Figure 1:
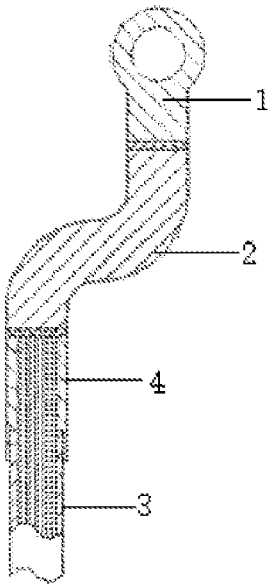
FIG. 1 is a schematic view showing a first structure of a copper-aluminum connector according to the present application.
Figure 2:
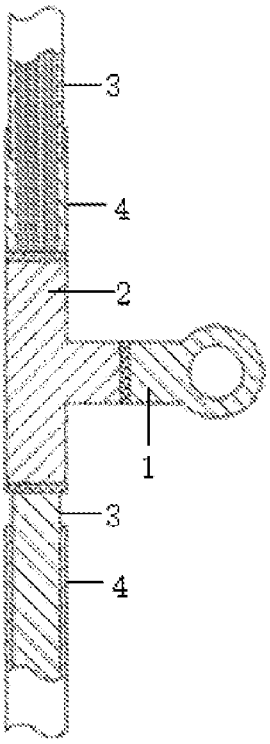
FIG. 2 is a schematic view showing a second structure of a copper-aluminum connector according to the present application.

| Reference numerals in FIGS. 1 and 2: | |
|---|---|
| 1 copper terminal, | 2 connecting part, |
| 3 aluminum wire, | 4 aluminum terminal. |

DETAILED DESCRIPTION OF EMBODIMENTS

In order to further elaborate the technical means adopted by the present application to achieve an intended objective of the present application, the specific embodiment, structure and features of the present application are described in detail below with reference to the drawings and preferred embodiments.

First Embodiment

FIGS. 1 and 2 show a copper-aluminum connector described in the present application, the copper-aluminum connector includes at least one copper terminal 1 for connection to a power consumption device, and at least one aluminum wire 3 for connection to an electrical circuit. In order to connect multiple copper terminals 1 with aluminum wire 3 together, the copper-aluminum connector further includes a connecting part 2. The connecting part 2 includes at least one first connecting end for connection to the copper terminal 1 and at least one second connecting end for connection to the aluminum wire 3, and in this way, it is convenient for people to determine the numbers of the copper terminal 1, the aluminum wire 3, the first connecting end and the second connecting end according to the actual needs, thus the copper-aluminum connector can be directly applied to a power consumption device with a large current demand, which not only saves the use space and cost, but also improves the assembly efficiency of the copper-aluminum connector.

In order to improve the stability of the connection between the connecting part 2 and the copper terminal 1, an end portion of the copper terminal 1 is connected to the first connecting end by welding.

In this embodiment, welding surfaces of the first connecting end and the end portion of the copper terminal 1 are either a plane, a curved surface or a folded surface. Specifically, when the welding surfaces of the first connecting end and the end portion of the copper terminal 1 are planes, the end portion of the copper terminal 1 can be more easily aligned with the first connecting end in welding, thereby facilitating the welding of the first connecting end and the end portion of the copper terminal 1. When the welding surfaces of the first connecting end and the end portion of the copper terminal 1 are curved surfaces or folded surfaces, an effective area of contact between an end surface of the first connecting end and the end portion of the copper terminal 1 can be increased, thus not only ensuring that the copper-aluminum connector has good electrical conductivity, but also enhancing the mechanical performance of the copper terminal 1 when welded to the first connecting end.

In order to improve the firmness of connection between the copper terminal 1 and the connecting part 2 after being welded together, a diameter of the end surface of the first connecting end is not less than ⅕ of the diameter of the end portion of the copper terminal 1, and not greater than 3 times the diameter of the end portion of the copper terminal 1.

In order to improve the stability of connection between the connecting part 2 and the aluminum wire 3 and prevent the aluminum wire 3 from being separated from the connecting part 2 under the action of an external force as far as possible, the aluminum wire 3 is connected to the second connecting end by welding.

The copper-aluminum connector further includes at least one crimping terminal for crimping to the aluminum wire 3, and after being connected to the aluminum wire 3 by crimping, the crimping terminal is connected to the second connecting end by friction welding. Specifically, in this embodiment, the crimping terminal is an aluminum terminal 4, and in connection, the aluminum terminal 4 is crimped onto the aluminum wire 3 to form a crimping surface, and the crimping surface is connected to the end surface of the second connecting end by friction welding. Since the aluminum terminal 4 is crimped onto the aluminum wire 3 to form a hard joint, when the joint is connected to the connecting part 2 by friction welding, the amounts of the deformation of the joint and the connecting part are substantially the same, so that the aluminum wire 3 and the aluminum terminal 4 will not bear a large upsetting pressure in the process of welding, thereby avoiding the problem of cracking or insufficient welding of the aluminum terminal 4 and the aluminum wire 3 after the crimping. Moreover, the hard joint is not only conducive to the welding between the connecting part 2 and the aluminum wire 3, but also ensures the mechanical performances of the aluminum wire 3 after being welded to the connecting part 2.

In order to facilitate the welding between the copper terminal 1 and the aluminum wire 3, the shape of the cross section of the second connecting end is circular or polygonal.

The connecting part 2 is a solid structure or a hollow structure. When the connecting part 2 is the solid structure, not only the stability of the connecting part 2 when being connected to the copper terminal 1 and the aluminum wire 3 can be improved, but also the mechanical strength of the connecting part 2 can be further improved after being connected to the copper terminal 1 and the aluminum wire 3. When the connecting part 2 is the hollow structure, the production cost of the connecting part 2 can be effectively reduced.

Specifically, the connecting part 2 is a hollow tubular structure with openings at two ends, a hollow tubular structure with an opening at one end, or a structure with a hollow portion between the first connecting end and the second connecting end. In order to ensure the reliability of the connection among the connecting part 2, the aluminum wire 3 and the copper terminal 1, a wall thickness of the hollow portion of the connecting part 2 is 0.5 mm to 8 mm.

In order to reduce the electrochemical corrosion caused by different electrode potentials after the aluminum wire 3 is connected to the connecting part 2, the electrode potential of the material of the connecting part 2 is between copper and aluminum. Specifically, the connecting part 2 is made of aluminum, aluminum alloy, cooper, copper alloy, zinc, zinc alloy, magnesium, magnesium alloy, nickel, nickel alloy, tin, tin alloy, manganese, manganese alloy, lithium or lithium alloy.

In order to ensure that the connecting part 2 has good electrical conductivity, the connecting part 2 is made of silver, silver alloy, gold, gold alloy, boron, boron alloy or graphene.

In addition, since the connecting part 2 can connect multiple copper terminals 1 with multiple aluminum terminals 4 together, in order to make the copper-aluminum connector applicable for different power consumption devices, the connecting part 2 can be arranged to have different shapes according to the installation positions and spaces, for mounting the copper-aluminum connector, of the different power consumption devices, thereby improving the convenience of installation of the copper-aluminum connector while saving the installation space.

Second Embodiment

The only difference between this embodiment and the first embodiment is described as follows.

The end portion of the copper terminal 1 is connected to the first connecting end by crimping, so that the copper terminal 1 can be connected to the connecting part 2 without using an auxiliary tool, thus greatly saving the time for connecting the copper terminal 1 with the connecting part 2.

Third Embodiment

The only difference between this embodiment and the first embodiment is described as follows.

The aluminum wire 3 is connected to the second connecting end by crimping, so that the aluminum wire 3 can be connected to the connecting part 2 without using an auxiliary tool, thus greatly saving the time for connecting the aluminum wire 3 with the connecting part 2.

Fourth Embodiment

The only difference between this embodiment and the first embodiment is described as follows.

The end portion of the copper terminal 1 is connected to the first connecting end by crimping, so that the copper terminal 1 can be connected to the connecting part 2 without using an auxiliary tool, thus greatly saving the time for connecting the copper terminal 1 with the connecting part 2.

Moreover, the aluminum wire 3 is connected to the second connecting end by crimping, so that the aluminum wire 3 can be connected to the connecting part 2 without using an auxiliary tool, thus greatly saving the time for connecting the aluminum wire 3 with the connecting part 2.

The above embodiments are only the preferred embodiments of the present application, which cannot be used to limit the scope of protection of the present application, and any insubstantial changes and substitutions made by those skilled in the art based on the present application belong to the scope of protection of the present application.

The invention claimed is:

1. A copper-aluminum connector, comprising a plurality of copper terminals each for connection to a different power consumption device, and a plurality of aluminum wires each for connection to an electrical circuit, wherein, the copper-aluminum connector further comprises a connecting part, and the connecting part comprises at least one first connecting end for connection to an end portion of the copper terminal and at least one second connecting end for connection to the aluminum wire, and wherein the connecting part connects the plurality of copper terminals with the plurality of aluminum wires, wherein, the aluminum wire is connected to the second connecting end by welding.

2. The copper-aluminum connector according to claim 1, wherein, the end portion of the copper terminal is connected to the first connecting end by crimping.

3. The copper-aluminum connector according to claim 1, wherein, the end portion of the copper terminal is connected to the first connecting end by welding.

4. The copper-aluminum connector according to claim 3, wherein, welding surfaces of the first connecting end and the end portion of the copper terminal are either a plane, a curved surface or a folded surface.

5. The copper-aluminum connector according to claim 3, wherein, a diameter of an end surface of the first connecting end is not less than 1/5 of a diameter of the end portion of the copper terminal, and not greater than 3 times the diameter of the end portion of the copper terminal.

6. The copper-aluminum connector according to claim 1, wherein, the copper-aluminum connector further comprises at least one crimping terminal for crimping to the aluminum wire, and after being connected by crimping, the crimping terminal and the aluminum wire are connected to the second connecting end by friction welding.

7. The copper-aluminum connector according to claim 1, wherein, a cross section of the second connecting end is circular or polygonal.

8. The copper-aluminum connector according to claim 2, wherein, the connecting part is a solid structure or a hollow structure.

9. The copper-aluminum connector according to claim 2, wherein, the connecting part is made of aluminum, aluminum alloy, copper, copper alloy, zinc, zinc alloy, magnesium, magnesium alloy, nickel, nickel alloy, tin, tin alloy, manganese, manganese alloy, lithium or lithium alloy.

10. The copper-aluminum connector according to claim 2, wherein, the connecting part is made of silver, silver alloy, gold, gold alloy, boron, boron alloy or graphene.

11. The copper-aluminum connector according to claim 3, wherein, the connecting part is a solid structure or a hollow structure.

12. The copper-aluminum connector according to claim 3, wherein, the connecting part is made of aluminum, aluminum alloy, copper, copper alloy, zinc, zinc alloy, magnesium, magnesium alloy, nickel, nickel alloy, tin, tin alloy, manganese, manganese alloy, lithium or lithium alloy.

13. The copper-aluminum connector according to claim 3, wherein, the connecting part is made of silver, silver alloy, gold, gold alloy, boron, boron alloy or graphene.

14. The copper-aluminum connector according to claim 4, wherein, the connecting part is a solid structure or a hollow structure.

15. The copper-aluminum connector according to claim 4, wherein, the connecting part is made of aluminum, aluminum alloy, copper, copper alloy, zinc, zinc alloy, magnesium, magnesium alloy, nickel, nickel alloy, tin, tin alloy, manganese, manganese alloy, lithium or lithium alloy.

16. The copper-aluminum connector according to claim 4, wherein, the connecting part is made of silver, silver alloy, gold, gold alloy, boron, boron alloy or graphene.

* * * * *